US007884044B2

(12) United States Patent
DiFranco et al.

(10) Patent No.: US 7,884,044 B2
(45) Date of Patent: Feb. 8, 2011

(54) PD-CONTAINING COATINGS FOR LOW CHLORINE OVERVOLTAGE

(75) Inventors: Dino F. DiFranco, Wayfield Village, OH (US); Kenneth L. Hardee, Middlefield, OH (US)

(73) Assignee: Eltech Systems Corporation, Chardon, OH (US)

( * ) Notice: Subject to any disclaimer, the term of this patent is extended or adjusted under 35 U.S.C. 154(b) by 855 days.

(21) Appl. No.: 11/661,819

(22) PCT Filed: Sep. 1, 2004

(86) PCT No.: PCT/US2004/028454

§ 371 (c)(1), (2), (4) Date: Mar. 1, 2007

(87) PCT Pub. No.: WO2006/028443

PCT Pub. Date: Mar. 16, 2006

(65) Prior Publication Data

US 2007/0289865 A1 Dec. 20, 2007

(51) Int. Cl.

| | |
|---|---|
| ***H01M 4/88*** | (2006.01) |
| ***H01M 4/90*** | (2006.01) |
| ***H01M 4/92*** | (2006.01) |
| ***C25B 11/06*** | (2006.01) |
| ***C25B 11/08*** | (2006.01) |

(52) U.S. Cl. ..... 502/101; 204/284; 204/290.01; 204/290.12; 204/290.14; 205/50; 205/149; 205/150; 205/152; 205/154; 205/205; 205/207; 205/208; 205/212; 205/333

(58) Field of Classification Search ..... 502/101; 205/50, 149, 150, 152, 154, 205, 207, 208, 205/212, 333; 204/284, 290.01, 290.12, 204/290.14

See application file for complete search history.

(56) References Cited

U.S. PATENT DOCUMENTS

| | | | | |
|---|---|---|---|---|
| 4,517,068 | A * | 5/1985 | Hinden et al. | 204/283 |
| 4,530,742 | A * | 7/1985 | Carlin et al. | 205/505 |
| 5,314,601 | A * | 5/1994 | Hardee et al. | 204/290.03 |

* cited by examiner

*Primary Examiner*—Bruce F Bell
(74) *Attorney, Agent, or Firm*—Eschweiler & Associates, LLC

(57) ABSTRACT

The present invention relates to an electrocatalytic coating and an electrode having the coating thereon, wherein the coating is a mixed metal oxide coating, preferably platinum group metal oxides with or without valve metal oxides, and containing a transition metal component such as palladium, rhodium or cobalt. The electrocatalytic coating can be used especially as an anode component of an electrolysis cell for the electrolysis of a halogen-containing solution wherein the palladium component reduces the operating potential of the anode and eliminates the necessity of a "break-in" period to obtain the lowest anode potential.

39 Claims, No Drawings

PD-CONTAINING COATINGS FOR LOW CHLORINE OVERVOLTAGE

This application is a national phase application filed under 35 U.S.C. §371 of PCT Application Number PCT/US2004/028454, filed Sep. 1, 2004.

BACKGROUND OF THE INVENTION

1. Field of the Invention

The invention is directed to an electrode and an electrocatalytic coating thereon for use in aqueous chlor-alkali solutions which provides a lower start-up and overall operating voltage.

2. Description of the Related Art

Electrodes for use in electrolytic processes have been known which have a base or core metal bearing a layer or coating of metal oxides. The core metal of the electrode may be a valve metal such as titanium, tantalum, zirconium, niobium or tungsten. Where the coating is an oxide mixture, an oxide of the core or substrate can contribute to the mixture. Such mixture can include an oxide of the substrate metal plus at least one oxide of a metal such as platinum, iridium, rhodium, palladium, ruthenium and osmium. Such electrodes are known in the art and generally referred to as "dimensionally stable".

An inherent drawback of these coatings in a chlorine/chlorate production environment, however, is the detrimental effect on chlorine evolution potential, leading to a higher operating potential and the necessity for a voltage "break-in" period during which the anode operates at a higher potential for up to several months.

Attempts to overcome the disadvantage associated with chlorine evolution potential have been addressed in U.S. Pat. No. 4,233,340 in which there is provided an insoluble electrode having a coating containing a baked slurry of palladium oxide containing a platinum compound which can be thermally decomposed to form platinum metal. The coating contains 99 to 5 mol % palladium oxide and 1 to 95 mol % platinum metal. In U.S. Pat. No. 4,443,317 there is taught an electrode for electrolysis having a coating consisting of 40 to 90 mol % palladium oxide, 0.1 to 20 mol % platinum and 5 to 50 mol % $(Ru_xTi_{1-x}))_2$.

Therefore, it would be advantageous to provide an electrode having a coating thereon which would eliminate the necessity for a voltage "break-in" period and provide an overall lower operating potential. It would be further desirable for such an electrode and coating to prevent or eliminate an escalation in voltage following postbaking of the coating.

SUMMARY OF THE INVENTION

There has now been found an electrode having an electrocatalytic coating thereon which provides a reduction in the operating potential of the electrode in electrochemical cells for the oxidation of chloride to chlorine. The coating further allows for the elimination of the voltage "break-in" period necessary to obtain the lowest anode potential, and elimination of the anode potential escalation observed after postbake/creep steps.

DESCRIPTION OF THE INVENTION

According to the present invention, an electrode encompassing an electrocatalytic coating having a lower operating potential and elimination of a voltage "break-in" period is provided. The electrode of the invention is particularly useful in the electrolytic production of chlorine and alkali metal hydroxides in membrane cells, the electrolytic production of chlorates and hypochlorites.

The electrode used in the present invention comprises an electrocatalytically active film on a conductive substrate. The metals for the electrode are broadly contemplated to be any coatable metal. For the particular application of an electrocatalytic coating, the metal might be such as nickel or manganese, but will most often be a "film-forming" metal. By "film-forming metal" it is meant a metal or alloy which has the property that when connected as an anode in the electrolyte in which the coated anode is subsequently to operate, there rapidly forms a passivating oxide film which protects the underlying metal from corrosion by electrolyte, i.e., those metals and alloys which are frequently referred to as "valve metals". Such valve metals include titanium, tantalum, zirconium, niobium, tungsten and silicon, and alloys containing one or more of these metals, as well as metal alloys and intermetallic mixtures, ceramics and cermets containing valve metal, (e.g., Ti—Ni, Ti—Co, Ti—Fe and Ti—Cu). More specifically, grade 5 titanium may include up to 6.75 weight percent aluminum and 4.5 weight percent vanadium, grade 6 up to 6 percent aluminum and 3 percent tin, grade 7 up to 0.25 weight percent palladium, grade 10 from 10 to 13 weight percent plus 4.5 to 7.5 weight percent zirconium, and so on. Of particular interest for its ruggedness, corrosion resistance and availability is titanium.

By use of elemental metals, it is most particularly meant the metals in their normally available condition, i.e., having minor amounts of impurities. Thus, for the metal of particular interest, i.e., titanium, various grades of the metal are available including those in which other constituents may be alloys or alloy plus impurities. Grades of titanium have been more specifically set forth in the standard specifications for titanium detailed in ASTM B 265-79.

Plates, rods, tubes, wires or knitted wires and expanded meshes of titanium or other film-forming metals can be used as the electrode base. Titanium or other film-forming metal clad on a conducting core can also be used.

Regardless of the metal selected and the form of the anode base member, the surface of such substrate member advantageously is a cleaned surface. This may be obtained by any of the known treatments to achieve a clean metal surface, including mechanical cleaning. The usual cleaning procedures of degreasing, either chemical or electrolytic, or other chemical cleaning operation may also be used to advantage. Where the base preparation includes annealing, and the metal is grade 1 titanium, the titanium can be annealed at a temperature of at least about 450° C. for a time of at least about 15 minutes, but most often a more elevated annealing temperature, e.g., 600° C. to 875° C. is advantageous.

When a cleaned surface, or prepared and cleaned surface has been obtained, and particularly for applying the necessary multiple coating layers which will be on the valve metal base, the base surface may be further treated to enhance adhesion such as of the electrocatalytic coating layers to the valve metal. This will be achieved by means which include intergranular etching of the substrate metal, sharp grit blasting of the metal surface, peening, abrading, plasma spraying or combinations thereof, followed by optional surface treatment to remove embedded grit.

To prepare a metal such as titanium for etching, it can be most useful to condition the metal, as by annealing, to diffuse impurities to the grain boundaries. Thus, by way of example, proper annealing of grade 1 titanium will enhance the concentration of the iron impurity at grain boundaries. Also for the aspect of etching, it can be desirable to combine a metal surface having a correct grain boundary metallurgy with an advantageous grain size. Again, referring to titanium as exemplary, at least a substantial amount of the grains having grain size number within a range of from about 3 to about 7 is advantageous. Grain size number as referred to herein is in accordance with the designation provided in ASTM E 112-84. A serviceable metal substrate of this condition has been disclosed in U.S. Pat. No. 5,167,788.

A suitably roughened metal surface can be obtained by special grit blasting with sharp grit, optionally followed by removal of surface embedded grit. The grit, which will usually contain angular particles, will cut the metal surface as opposed to peening the surface. Serviceable grit for such purpose can include sand, aluminum oxide, steel and silicon carbide Etching, or other treatment such as water blasting, following grit blasting can be used to remove embedded grit and/or clean the surface. Etching will be with a sufficiently active etch solution, typically an acid solution, to develop a surface roughness and/or surface morphology, including possible aggressive grain boundary attack. These can be provided by hydrochloric, sulfuric, perchloric, nitric, oxalic, tartaric, and phosphoric acids as well as mixtures thereof, e.g., aqua regia. Other etchants that may be utilized include caustic etchants such as a solution of potassium hydroxide with potassium nitrate. Following etching, the etched metal surface can then be subjected to rinsing and drying steps.

The electrode having the electrocatalytic coating described herein will virtually always find service as an anode. Thus, the word "anode" is often used herein when referring to the electrode, but this is simply for convenience and should not be construed as limiting the invention.

In plasma spraying for a suitably roughened metal surface, the material will be applied in particulate form such as droplets of molten metal. In this plasma spraying, such as it would apply to spraying of a metal, the metal is melted and sprayed in a plasma stream generated by heating with an electric arc to high temperatures in inert gas, such as argon or nitrogen, optionally containing a minor amount of hydrogen. It is to be understood by the use herein of the term "plasma spraying" that although plasma spraying is preferred the term is meant to include generally thermal spraying such as magnetohydrodynamic spraying, flame spraying and arc spraying, so that the spraying may simply be referred to as "melt spraying" or "thermal spraying".

The particulate material employed may be a valve metal or oxides thereof, e.g., titanium oxide, tantalum oxide and niobium oxide. It is also contemplated to melt spray titanates, spinels, magnetite, tin oxide, lead oxide, manganese oxide and perovskites. It is also contemplated that the oxide being sprayed can be doped with various additives including dopants in ion form such as of niobium or tin or indium.

It is also contemplated that such plasma spray application may be used in combination with etching of the substrate metal surface. Or the electrode base may be first prepared by grit blasting, as discussed hereinabove, which may or may not be followed by etching.

It will be understood from the foregoing that the surface may then proceed through various operations, providing a pretreatment before coating, e.g., the above-described plasma spraying of a valve metal oxide coating. Other pretreatments may also be useful. For example, it is contemplated that the surface be subjected to a hydriding or nitriding treatment. Application of a barrier layer can optionally be included following the obtaining of a suitably roughened surface. A melt-sprayed ceramic oxide roughened surface may serve as a satisfactory barrier layer. Prior to coating with an electrochemically active material, it has been proposed to provide an oxide layer by heating the substrate in air or by anodic oxidation of the substrate as described in U.S. Pat. No. 3,234,110. Various proposals have also been made in which an outer layer of electrochemically active material is deposited on a sublayer, which primarily serves as a protective and conductive intermediate. Various tin oxide based underlayers are disclosed in U.S. Pat. Nos. 4,272,354, 3,882,002 and 3,950,240. It is also contemplated that the surface may be prepared as with an antipassivation layer.

Following surface preparation, which might include providing a pretreatment layer such as described above, an electrochemically active coating layer can be applied to the substrate member. As is typically representative of the electrochemically active coatings that are often applied, are those provided from active oxide coatings such as platinum group metal oxides, magnetite, ferrite, cobalt spinel or mixed metal oxide coatings, tin oxide, and antimony oxide, and/or contains a mixed crystal material of at least one oxide of a valve metal and at least one oxide of a platinum group metal, and/or contains one or more of manganese dioxide, lead dioxide, palatinate substituent, nickel-nickel oxide or a mixture of nickel plus lanthanum oxides. They may be water based, such as aqueous solutions, or solvent based, e.g., using alcohol solvent. However, it has been found that for the electrode of the present invention, an important aspect of the preferred coating composition solutions are those containing a transition metal oxide comprising one or more of palladium, rhodium or cobalt, with palladium being preferred. The coating compositions will contain $PdCl_2$, $RhCl_3$ or $CoCl_2$ and hydrochloric acid or in alcohol solution. The metal salts can be utilized in a form such as $PdCl_2xH_2O$, $RhCl_3xH_2O$, and $COCl_2xH_2O$. For convenience, such forms will generally be referred to herein simply as $PdCl_2$, $RhCl_3$ or $CoCl_3$. Generally, the metal chloride will be dissolved in an alcohol such as either isopropanol or butanol, all combined with or with out small additions of hydrochloric acid, with n-butanol being preferred.

In each embodiment of the present invention, as described further hereinbelow, the coating compositions will contain the transition metal constituent in an amount from about 0.01 mole % up to about 10 mole %, basis 100 mole % of the total platinum group metal oxide content of the coating, with a preferred range being from about 0.1 mole % up to about 8 mole %. It will be understood that the constituents are substantially present as their oxides, and the reference to the metals is for convenience, particularly when referring to proportions.

It was unexpected that the use of such small amounts of the transition metal constituent in the coating compositions of the present invention would provide a reduction in the operating potential for chlor-alkali electrolysis of from about 10 millivolts (mV) up to about 100 mV, depending on the potential value of the coating without the transition metal constituent. Previous coatings, as described hereinabove, have utilized large amounts of palladium oxide of upwards of 40% or more or in combination with other metals. Thus, it was not expected to achieve a desirable coating composition as disclosed in the present invention with a more simplistic coating composition as described.

In a first embodiment of the present invention, as is described in PCT. patent application Ser. No. PCT/US04/14357, which is fully incorporated by reference herein, the coating composition will contain, in addition to the Pd constituent as described hereinabove, an element of ruthenium oxide in combination with titanium oxide and antimony or tin oxides. It is contemplated that the coating composition may optionally contain iridium oxide. The coating compositions of the first embodiment, then, are those comprised of $RuCl_3$, $TiCl_3$, $SbCl_3$, and hydrochloric acid, all in aqueous solution. It has been found that, for the electrochemically active coating of the first embodiment, it is preferred that the coating formulation is prepared using a water base, as opposed to an alcohol base.

The coating composition of the first embodiment will contain sufficient ruthenium constituent to provide at least about 10 mole percent up to about 30 mole percent, and preferably from about 15 mole percent up to about 25 mole percent, basis 100 mole percent of the metal content of the coating. It will be understood that the constituents are substantially present as their oxides, and the reference to the metals is for convenience, particularly when referring to proportions.

A valve metal component will be included in the coating composition of the first embodiment. Various valve metals can be utilized including titanium, tantalum, niobium, zirconium, hafnium, vanadium, molybdenum, and tungsten, with titanium being preferred. Salts of the dissolved metal are utilized, and suitable inorganic substituents can include chlorides, iodides, bromides, sulfates, borates, carbonates, acetates, and citrates, e.g., $TiCl_3$ *or*, $TiCl_4$, in acid solutions. Such coating composition will contain sufficient Ti constituent to provide at least about 50 mole percent up to about 85 mole percent and preferably from about 60 mole percent up to about 75 mole percent, basis 100 mole percent of the metal content of the coating.

Where the coating composition of the first embodiment will contain iridium oxide, suitable precursor substituents can include $IrCl_3$ or $H_2IrCl_6$. The iridium oxide will be present in an amount from about 1% mole percent up to about 25 mole percent, basis 100 mole percent of the metal content of the coating.

A preferred first embodiment coating composition will contain antimony oxide. Suitable precursor substituents can include $SbCl_3$, $SbCl_5$, or other inorganic antimony salts. The antimony oxide will generally be present in an amount from about 5 mole percent up to about 20 mole percent and preferably from about 10 mole percent up to about 15 mole percent, basis 100 mole percent of the metal content of the coating.

As mentioned hereinbefore, it is also contemplated that the first embodiment electrocatalytic coating can contain a tin oxide in place of or in addition to antimony oxide. Where tin oxide is the desired constituent, suitable precursor substituents can include $SnCl_2$, $SnSO_4$, or other inorganic tin salts. Where tin oxide is utilized, it will generally be present in an amount from about 2 mole percent up to about 20 mole percent and preferably from about 3 mole percent up to about 15 mole percent, basis 100 mole percent of the metal content of the coating.

In the coating composition of the first embodiment, the ratio of ruthenium to antimony or tin will generally be from about 2:1 to about 0.1:1, and preferably about 1.5:1, with the ratio of titanium to antimony or tin being from about 19:1 to 1:1, and preferably about 5.7:1. Where the optional iridium component is utilized, the ratio of ruthenium to iridium will generally be from about 1:1 to about 99:1.

In a second embodiment of the present invention, as is described in U.S. patent application Ser. No. 10/395,939, which is fully incorporated herein by reference, the preferred coating composition solutions are typically those consisting of $RuCl_3$ and $IrCl_3$ and hydrochloric acid, all in alcohol solution, with or without the presence of a valve metal component. It is also contemplated to utilize chloriridic acid, $H_2IrCl_6$. It will be understood that the $RuCl_3$ may be utilized in a form such as $RuCl_3xH_2O$ and $IrCl_3.xH_20$ can be similarly utilized. For convenience, such forms will generally be referred to herein simply as $RuCl_3$ and $IrCl_3$. Generally, the ruthenium chloride will be dissolved along with the iridium chloride in an alcohol such as either isopropanol or butanol, all combined with or with out small additions of hydrochloric acid, with n-butanol being preferred.

Such second embodiment coating composition will contain sufficient ruthenium constituent to provide at least about 5 mole percent, up to about 50 mole percent of ruthenium metal, basis 100 mole percent of the metal content of the coating, with a preferred range being from about 15 mole percent to up to about 35 mole percent of ruthenium. It will be understood that the constituents are substantially present as their oxides, and the reference to the metals is for convenience, particularly when referring to proportions.

The coating composition of the second embodiment will contain sufficient Ir constituent to provide at least about 50 mole percent up to about 95 mole percent iridium metal, basis 100 mole percent of iridium and ruthenium metals, with a preferred range being from about 50 mole percent up to about 75 mole percent iridium. For best coating characteristics, then, the molar ratio of Ru:Ir will be from about 1:1 to about 1:4 with a preferred ratio being about 1:1.6.

A valve metal component may optionally be included in the second embodiment coating composition in order to further stabilize the coating and/or alter the anode efficiency As set forth hereinabove with reference to the invention first embodiment, various valve metals can be utilized including titanium, tantalum, niobium, zirconium, hafnium, vanadium, molybdenum, and tungsten. The valve metal component can be formed from a valve metal alchoxide in an alcohol solvent, with or without the presence of an acid. Such valve metal alchoxides which are contemplated for use in the present invention include methoxides, ethoxides, isopropoxides and butoxides. For example, titanium ethoxide, titanium propoxide, titanium butoxide, tantalum ethoxide, tantalum isopropoxide or tantalum butoxide may be useful.

When the valve metal component is present in the second embodiment composition, the coating will contain from about 0.1 mole percent up to not greater than 25 mole percent basis 100 mole percent of the metal content of the coating, with the preferred composition containing from about 5 mole percent up to about 15 mole percent.

In a third embodiment, as is described in U.S. Pat. No. 5,230,780, which is fully incorporated herein by reference, the coating composition will consist of, in addition to the transition metal constituent, a solution of iridium, ruthenium, and titanium oxides. Usually, each precursor constituent will be a metal salt that most often is a halide salt and preferably for economy coupled efficiency of solution preparation such will all be the chloride salt. However, other useful salts include iodides, bromides and ammonium chloro salts such as ammonium hexachloro iridate or ruthenate. The coating composition applied to the metal substrate will be aqueous, which will most always be simply water without any blending with further liquid. Preferably, deionized or distilled water is used to avoid inorganic impurities.

In the individual or combination solutions of the third embodiment, in addition to the suitable precursor substituent, most always with only one exception no further solution ingredients will be present. Such exception will virtually always be the presence of inorganic acid. For example, a solution of iridium trichloride can further contain strong acid, most always hydrochloric acid, which will usually be present in an amount to supply about 5 to about 20 weight percent acid. Typically, the individual or combination solutions will have a pH of less than 1, such as within the range of from about 0.2 to about 0.8. The palladium oxide of the topcoating layer will be present in an amount from about 0.1 mole % up to about 8 mole % .

The coating composition, then, of the third embodiment, will contain at least about 15, but less than 25 mole percent of the iridium constituent, from about 35 to about 50 mole percent of the ruthenium constituent, and at least about 30, but less than 45 mole percent of the titanium constituent, basis 100 mole percent of these constituents. For best coating characteristics, the molar ratio of ruthenium oxide to iridium oxide in the resulting coating will be from greater than about 1.5:1 up to about 3:1. The resulting coating will furthermore have a molar ratio of titanium oxide to the total of the oxides of iridium plus ruthenium of less than about 1:1, but most always above 0.5:1.

In a fourth embodiment of the present invention, the preferred coating compositions are those containing ruthenium, iridium and titanium oxides. As described hereinabove, suitable precursor constituents will include $RuCl_3$, $IrCl_3$, and ortho butyl titanate, in alcohol solution. The coating composition, then, of the fourth embodiment, will contain from about 2 to about 20 mole percent of the iridium constituent, from about 10 to about 30 mole percent of the ruthenium constituent, and from about 50 to about 85 mole percent of the titanium constituent, basis 100 mole percent of these constituents in the coating.

In each of the foregoing embodiments, there has been described a coating composition containing the transition metal oxide in combination with a mixed metal oxide coating as the electrochemically active coating layer. In a fifth embodiment of the present invention, it is contemplated that a topcoating layer of a transition metal comprising one or more of palladium, rhodium or cobalt, with palladium being preferred, can be applied over an intermediate layer of an electrochemically active coating layer. The topcoating layer can be formed from a dilute solution of the transition metal in alcohol or water, with or without the presence of acid. Generally, the transition metal component will be present in an amount from about 0.2 to about 10 g/l of metal. The preferred topcoating layer will be formed from $PdCl_2$ in hydrochloric acid.

Any of the foregoing coating compositions can be applied to the metal substrate by any of those means typically utilized for applying a liquid coating composition to a metal substrate. Such methods of application include dip spin and dip drain techniques, brush application, roller coating and spray application such as electrostatic spray. Moreover, spray application and combination techniques, e.g., dip drain with spray application can be utilized. Spray application can be either conventional compressed gas or can be electrostatic spray application. With the above-mentioned coating compositions for providing an electrochemically active coating, a roller coating operation can be most serviceable.

Regardless of the method of application of the coating, conventionally, a coating procedure is repeated to provide a uniform, more elevated coating weight than achieved by just one coating. However, the amount of coating applied will be sufficient to provide in the range of from about 0.1 $g/m^2$ (gram per square meter) total metals to about 20 $g/m^2$, and preferably, from about 3 $g/m^2$ to about 12 $g/m^2$.

Following application of the coating, the applied composition will be heated to prepare the resulting mixed oxide coating by thermal decomposition of the precursors present in the coating composition. This prepares the mixed oxide coating containing the mixed oxides in the molar proportions, basis the metals of the oxides, as above discussed. Such heating for the thermal decomposition will be conducted at a temperature of at least about 350° C. for a time of at least about 3 minutes. More typically, the applied coating will be heated at a more elevated temperature of up to about 550° C. for a time of not more than about 20 minutes. Suitable conditions can include heating in air or oxygen. In general, the heating technique employed can be any of those that may be used for curing a coating on a metal substrate. Thus, oven coating, including conveyor ovens may be utilized. Moreover, infrared cure techniques can be useful. Following such heating, and before additional coating as where an additional application of the coating composition will be applied, the heated and coated substrate will usually be permitted to cool to at least substantially ambient temperature. Particularly after all applications of the coating composition are completed, postbaking can be employed. Typical postbake conditions for coatings can include temperatures of from about 400° C. up to about 550° C. Baking times may vary from about 10 minutes, up to as long as about 300 minutes.

As has been discussed hereinbefore, the coating of the present invention is particularly serviceable for an anode in an electrolytic process for the manufacture of chlorate and alkali metal hydroxides. However, it is also contemplated that these electrodes may find use in other processes, such as the manufacture of chlorine and hypochlorites.

EXAMPLE 1

Flat, titanium plates of unalloyed grade 1 titanium were etched in a 90-95° C. solution of 18-20% hydrochloric acid for 25 minutes to roughen the surfaces for coating application.

TABLE 1

| Solu- | | Grams per Liter of Metal in Coating | | | | | | | | | | Postbake | SEP @60 C., 300 gpl NaCl 8.88 | 2.66 | 0.88 |
|---|---|---|---|---|---|---|---|---|---|---|---|---|---|---|---|
| tion | Solvent | Ru | Ir | Sb | Sn | Ti | Ta | Pd | Rh | Co | Cure Temp/Time | Temp/Time | kA/m2 | kA/m2 | kA/m2 |
| A | Water/HCl | 24.5 | | 19.3 | 19.3 | 42.8 | | | | | 460-490 C./3-6 minutes | 470 C./90 minutes | 1.195 | 1.160 | 1.140 |
| A+ | Water/HCl | 24.5 | | 19.3 | 19.3 | 42.8 | | 0.8 | | | | | 1.106 | 1.088 | 1.080 |
| B | Water/HCl | 24.5 | | 19.3 | | 42.8 | | | | | 460-490 C./3-6 minutes | 470 C./90 minutes | 1.189 | 1.153 | 1.135 |
| B+ | Water/HCl | 24.5 | | 19.3 | | 42.8 | | 1.4 | | | | | 1.099 | 1.084 | 1.077 |
| C | Butanol | 20.9 | 20.9 | | | 43.9 | | | | | 460-490 C./3-6 minutes | 515 C./120 minutes | 1.201 | 1.169 | 1.149 |

TABLE 1-continued

| Solution | Solvent | Grams per Liter of Metal in Coating | | | | | | | | | Cure Temp/Time | Postbake Temp/Time | SEP @60 C., 300 gpl NaCl 8.88 kA/m2 | 2.66 kA/m2 | 0.88 kA/m2 |
|---|---|---|---|---|---|---|---|---|---|---|---|---|---|---|---|
| | | Ru | Ir | Sb | Sn | Ti | Ta | Pd | Rh | Co | | | | | |
| C+ | Butanol | 20.9 | 20.9 | | | 43.9 | | 1.3 | | | | | 1.118 | 1.099 | 1.089 |
| D | Water/HCl | 14.4 | 15.7 | | | 8 | | | | | 460-490 C./3-6 minutes | 525 C./180 minutes | 1.230 | 1.193 | 1.170 |
| D+ | Water/HCl | 14.4 | 15.7 | | | 8 | | 1.6 | | | | | 1.095 | 1.077 | 1.067 |
| E | Butanol | 3.3 | 10 | | | | 1.7 | | | | 460-490 C./3-6 minutes | 475 C./120 minutes | 1.137 | 1.119 | 1.108 |
| E+ | Butanol | 3.3 | 10 | | | | 1.7 | 0.8 | | | | | 1.093 | 1.077 | 1.069 |
| F | Water/HCl | 24.5 | | 19.3 | 19.3 | 42.8 | | | | | 460-490 C./3-6 minutes | N/A | 1.131 | 1.103 | 1.091 |
| F+ | Water/HCl | 24.5 | | 19.3 | 19.3 | 42.8 | | 0.8 | | | | | 1.108 | 1.088 | 1.080 |
| G | Butanol | 20.9 | 20.9 | | | 43.9 | | | | | 460-490 C./3-6 minutes | N/A | 1.125 | 1.101 | 1.088 |
| G+ | Butanol | 20.9 | 20.9 | | | 43.9 | | 1.3 | | | | | 1.094 | 1.079 | 1.071 |
| H | Water/HCl | 14.4 | 15.7 | | | 8 | | | | | 460-490 C./3-6 minutes | N/A | 1.120 | 1.098 | 1.086 |
| H+ | Water/HCl | 14.4 | 15.7 | | | 8 | | 1.6 | | | | | 1.093 | 1.075 | 1.067 |
| I | Butanol | 3.3 | 10 | | | | 1.7 | | | | 460-490 C./3-6 minutes | N/A | 1.135 | 1.112 | 1.097 |
| I+ | Butanol | 3.3 | 10 | | | | 1.7 | 0.8 | | | | | 1.107 | 1.094 | 1.073 |
| J+ | Water/HCl | 24.5 | | 19.3 | 19.3 | 42.8 | | | 1.3 | | 460-490 C./3-6 minutes | 460 C./90 minutes | 1.171 | 1.144 | 1.127 |
| K+ | Water/HCl | 24.5 | | 19.3 | 19.3 | 42.8 | | | | 1.3 | | | 1.173 | 1.146 | 1.129 |
| L+ | Water/HCl | 24.5 | | 19.3 | 19.3 | 42.8 | | | 1.3 | | 460-490 C./3-6 minutes | N/A | 1.113 | 1.094 | 1.083 |
| M+ | Water/HCl | 24.5 | | 19.3 | 19.3 | 42.8 | | | | 1.3 | | | 1.120 | 1.099 | 1.087 |

Coating compositions as set forth in Table 1 were applied. Coating solutions were prepared by adding the metals listed (as chloride salts) to either a butanol or a water/HCl solvent. After mixing to dissolve all of the salts, the solutions were applied to individual samples of prepared titanium plates. The coatings were applied in layers, with each coat being applied separately and allowed to dry at room temperature, followed by heating in air to the listed curing conditions. After application of the final coat, some of the samples were further baked in air at the temperature/time conditions listed in the postbake column of the table.

Standard Electrode Potentials (vs. SCE) were measured at 50 degrees Celsius in a 300 gpl NaCl solution on the coated samples. Table 1 shows the measured values and shows that for all the coatings listed, the presence of palladium in the formulation lowers the SEP value with and without the presence of a postbake operation.

EXAMPLE 2

Three samples of production made coatings were obtained from storage. The composition of the coatings and substrate type are shown in Table 2.

TABLE 2

| Sample | Solvent | Grams per Liter of Metal in Coating | | | | | | Substrate | Cure Temp/Time | Postbake Temp/Time | SEP @60 C., 300 gpl NaCl 8.88 kA/m2 | 2.66 kA/m2 | 0.88 kA/m2 |
|---|---|---|---|---|---|---|---|---|---|---|---|---|---|
| | | Ru | Ir | Sb | Sn | Ti | Ta | | | | | | |
| 1 | Water/HCl | 24.5 | | 19.3 | | 42.8 | | Plate | 460-490 C./3-6 minutes | 450-470 C./60-120 minutes | 1.216 | 1.175 | 1.156 |
| 2 | Butanol | 20.9 | 20.9 | | | 43.9 | | Plate | 460-490 C./3-6 minutes | none | 1.118 | 1.097 | 1.088 |
| 3 | Butanol | 3.3 | 10 | | | | 1.7 | Mesh | 460-490 C./3-6 minutes | none | 1.130 | 1.101 | 1.090 |
| 1 | | | | | One coat of 0.7 gpl Pd (as PdCl2 in 18 wt % HCl) applied and cured at 460-490 C. for 3-6 minutes. | | | | | | 1.107 | 1.088 | 1.080 |
| 2 | | | | | | | | | | | 1.111 | 1.091 | 1.081 |
| 3 | | | | | | | | | | | 1.132 | 1.098 | 1.087 |
| 1 | | | | | One coat of 0.7 gpl Pd (as PdCl2 in 18 wt % HCl) applied and cured at 460-490 C. for 3-6 minutes and postbaked for 470 C./90 minutes. | | | | | | 1.108 | 1.087 | 1.080 |
| 2 | | | | | | | | | | | 1.115 | 1.096 | 1.087 |
| 3 | | | | | | | | | | | 1.124 | 1.095 | 1.084 |

In order to remove any surface contamination, the coated substrates #1-3 were heated in an oven to 450-470° C. for approximately 5 minutes. SEP measurements were then made on the samples and are shown in Table 2. It can be noted from the data that sample #1 was previously postbaked and as such had elevated SEP values.

A solution of 0.7 g/l Pd (as $PdCl_2$) in 18 wt % HCl was prepared and one coat of this solution was applied to samples 4-6. The coating was allowed to air dry and the samples were placed in an oven at 460-490 C for 3-6 minutes in order to cure the coat. After removal from the oven and a subsequent cooling period, SEP measurements were again made on the samples. The data in Table 2 shows that sample 4 no longer had an elevated SEP and this is attributable to the topcoat of palladium solution applied.

The three samples 7-9 were subsequently postbaked at 470° C. for 90 minutes and the SEP's were again recorded. The data in Table 2 shows that none of the SEP's increased after the postbaking operation and this is attributable to the topcoat of palladium solution applied.

While in accordance with the patent statutes the best mode and preferred embodiment have been set forth, the scope of the invention is not limited thereto, but rather by the scope of the attached claims.

What we claim is:

1. A method for the production of an electrode for use in the electrolysis of a halogen-containing solution whereby said electrode provides reduced operating potential during said electrolysis, the method comprising the steps of:

a) providing a valve metal substrate having an intermediate coating layer thereon;

b) coating said valve metal substrate with a topcoating layer of a solution of a transition metal oxide consisting of one or more of palladium, rhodium, or cobalt oxides, said mixture providing from about 0.1 mole % up to about 10 mole % of the total transition metal oxide content of the coating.

2. A method according to claim 1, wherein said valve metal substrate is one or more of a valve metal mesh, sheet, blade, tube, punched plate or wire member and said valve metal is one or more of titanium, tantalum, aluminum, hafnium, niobium, zirconium, molybdenum or tungsten, their alloys and intermetallic mixtures thereof.

3. A method according to claim 2, wherein said a surface of said valve metal electrode base is a roughened surface and said roughened surface is prepared by one or more of intergranular etching, grit blasting, peening, abrading or plasma spraying.

4. A method according to claim 3, wherein there is established a ceramic oxide barrier layer as a pretreatment layer on said roughened surface.

5. A method according to claim 3, wherein said intermediate electrocatalytic coating comprises a platinum group metal or metal oxides, magnetite, ferrite, cobalt oxide spinel, tin oxide, and antimony oxide, and/or contains a mixed crystal material of at least one oxide of a valve metal and at least one oxide of a platinum group metal, and/or contains one or more of manganese dioxide, lead dioxde, palatinate substituent, nickel-nickel oxide or a mixture of nickel plus lanthanum oxides.

6. A method according to claim 5, wherein said transition metal oxide of said topcoating layer is palladium oxide, and said palladium oxide is present in an amount from about 0.1 mole % up to about 8 mole %.

7. A method according to claim 1, wherein said method further comprises the step of heating said coating and said heating is by baking at a temperature of from at least about 350° C. up to about 550° C. for a time of from at least about 3 minutes up to about 20 minutes.

8. A method according to claim 1, wherein said electrode is an anode in a process for the production of one or more of chlorine, chlorate or hypochlorite.

9. A method according to claim 1, wherein said electrode provides a reduction in the operating potential during said electrolysis in an amount from about 10 millivolts to about 100 millivolts.

10. A method according to claim 1, wherein said intermediate electrocatalytic coating layer and said topcoating layer are applied to said valve metal substrate by one or more of dip spin, dip drain, brush application, roller coating and spray application.

11. An electrolytic cell for the electrolysis of a halogen-containing solution containing the electrode made by the method of claim 1.

12. An electrode for use in the electrolysis of a halogen-containing solution, said electrode having an electrocatalytic coating thereon, with said electrode comprising:

a valve metal electrode base;

a coating layer of an electrochemically active coating on said valve metal electrode base, said coating comprising a combination of:

a) a solution of transition metal oxides consisting essentially of one or more of palladium, rhodium or cobalt oxides in an amount of from about 0.1 mole percent up to about 10 mol percent of the total transition metal oxide content of the coating;

b) a mixture of platinum group metal oxides, and optionally, a valve metal oxide in an amount not greater than 25 mole percent, said mixture of platinum group metal oxides consisting essentially of one or more of ruthenium and iridium oxide in a proportion providing from about 5 mole percent up to about 50 mole percent ruthenium, from about 50 mole percent up to about 95 mole percent iridium, basis 100 mole percent of the metals present in the coating;

wherein said electrochemically active coating provides reduced operating potential in said cell.

13. An electrode according to claim 12, wherein said valve metal electrode base is a valve metal mesh, sheet, blade, tube, punched plate or wire member and said valve metal electrode base is one or more of titanium, tantalum, aluminum, hafnium, niobium, zirconium, molybdenum or tungsten, their alloys and intermetallic mixtures thereof.

14. An electrode according to claim 13, wherein a surface of said valve metal electrode base is a roughened surface and said surface is roughened as by one or more of intergranlular etching, grit blasting, peening, abrading or thermal spraying.

15. An electrode according to claim 14, wherein the molar ratio of ruthenium oxide to iridium oxide is from about 1:1 to about 1:4.

16. An electrode according to claim 13, wherein there is established a ceramic oxide barrier layer as a pretreatment layer on said roughened surface.

17. An electrode according to claim 16, wherein there is established on said electrocatalytic coating at least one top coating layer containing a valve metal oxide coating or a tin oxide coating, or mixtures thereof.

18. An electrode according to claim 12, wherein said electrocatalytic coating includes said valve metal oxide.

19. An electrode according to claim 18, wherein said valve metal oxide is one or more of titanium oxide, tantalum oxide, zirconium oxide, niobium oxide, hafnium oxide, tin oxide and said valve metal oxide is present in an amount of about 0.1 mole percent to about 25 mole percent.

20. An electrode according to claim 12, wherein said transition metal oxide is palladium oxide and said palladium oxide is present in an amount from about 0.1 mole % up to about 8 mole %.

21. An electrode according to claim 12, wherein said coating further includes iridium oxide in an amount from about 1 mole percent to about 25 mole percent, basis 100 mole percent of the metal content of the coating, and the ratio of ruthenium metal to iridium is from about 1:1 to about 99:1.

22. An electrode of a valve metal substrate for use in an electrocatalytic process for the electrolysis of a halogen-containing solution, said valve metal substrate having an electrocatalytic surface coating thereon, wherein said coating consists essentially of a solution of a transition metal oxide of one or more of palladium, rhodium or cobalt, in combination with ruthenium oxide, titanium oxide and one or more of tin oxides or antimony oxides, said mixture providing from at least about 0.1 mole percent up to about 10 mole percent of said transition metal oxide, at least about 10 mole percent up to about 30 mole percent ruthenium, and at least about 50 mole percent up to about 85 mole percent titanium, basis 100 mole percent of the metal content in the coating, whereby said electrocatalytic coating provides reduced operating potential in said cell.

23. The electrode of claim 22, wherein said ruthenium oxide is present in an amount from about 10 mole percent up to about 25 mole percent, and said titanium is present in an amount from about 60 mole percent up to about 75 mole percent, basis 100 mole percent of the metal content of the coating.

24. The electrode of claim 22, wherein said coating contains from about 5 mole percent up to about 20 mole percent antimony oxide basis 100 mole percent of the metal content of the coating.

25. The electrode of claim 22, wherein said coating contains from about 2 mole percent up to about 20 mole percent tin oxide, basis 100 mole percent of the metal content of the coating.

26. The electrode of claim 22, wherein said coating contains from about 10 mole percent up to about 15 mole percent antimony oxide and from about 2 mole percent up to about 15 mole percent tin oxide, basis 100 mole percent of the metal content of the coating.

27. The electrode of claim 22, wherein the ratio of ruthenium metal to antimony or tin is from about 2:1 to about 0.1:1 and the ratio of titanium to antimony or tin is from about 19:1 to about 1:1.

28. The electrode of claim 22, wherein said coating is a water-based coating.

29. The electrode of claim 22, wherein said coating further includes iridium oxide in an amount from about 1 mole percent to about 25 mole percent, basis 100 mole percent of the metal content of the coating, and the ratio of ruthenium metal to iridium is from about 1:1 to about 99:1.

30. The electrode of claim 22, wherein said electrode provides a reduction in the operating potential during said electrolysis in an amount from about 10 millivolts to about 100 millivolts.

31. An electrolytic cell for the electrolysis of a chlor-alkali solution containing the electrode of claim 22.

32. An electrode for use in the electrolysis of a halogen-containing solution, said electrode comprising a valve metal substrate having an electrocatalytic surface coating thereon, wherein said surface coating consists essentially of a solution of a transition metal oxide of one or more of palladium, rhodium, or cobalt, in combination with ruthenium oxide, iridium oxide and titanium oxide, said mixture providing from at least about 0.1 mole percent up to about 10 mole percent of said transition metal oxide, from at least about 15 but less than 25 mole percent iridium oxide, from about 35 up to about 50 mole percent ruthenium oxide and at least about 30 mole percent but less than 45 mole percent titanium oxide, basis 100 mole percent of the oxides present in the coating, whereby the coating has a molar ratio of titanium oxide to the sum of the oxides of iridium and ruthenium of less than 1:1, with the molar ratio of ruthenium oxide to iridium oxide being from greater than 1.5:1 up to 3:1, and whereby said electrocatalytic coating provides reduced operating potential in said cell.

33. The electrode of claim 32, wherein said transition metal oxide is palladium oxide and said palladium oxide is present in an amount from about 0.1 mole % up to about 8 mole %.

34. An electrolytic cell for the electrolysis of a halogen-containing solution containing the electrode of claim 32.

35. The electrode of claim 32, wherein said operating potential is reduced in an amount from about 10 millivolts up to about 100 millivolts.

36. An electrode for use in the electrolysis of a halogen-containing solution, said electrode comprising a valve metal substrate having an electrocatalytic surface coating thereon, wherein said surface coating consists essentially of a solution of transition metal oxides of one or more of palladium, rhodium or cobalt in combination with ruthenium oxide, iridium oxide and titanium oxide, said mixture providing from at least about 0.1 mole percent up to about 10 mole percent of said transition metal oxides, from about 10 mole percent up to about 30 mole percent ruthenium, from about 2 mole percent up to about 20 mole percent iridium, and from about 50 mole percent up to about 85 mole percent titanium, whereby said electrocatalytic coating provides reduced operating potential in said cell.

37. The electrode of claim 36, wherein said transition metal oxide is palladium oxide and said palladium oxide is present in an amount from about 0.1 mole % up to about 8 mole%.

38. An electrolytic cell for the electrolysis of a halogen-containing solution containing the electrode of claim 36.

39. The electrode of claim 36, wherein said operating potential is reduced in an amount from about 10 millivolts up to about 100 millivolts.

* * * * *